US010065060B2

(12) United States Patent
Simmons

(10) Patent No.: US 10,065,060 B2
(45) Date of Patent: Sep. 4, 2018

(54) STATIC-DYNAMIC EXERCISE APPARATUS AND METHOD OF USING SAME

(71) Applicant: Louie Simmons, Columbus, OH (US)

(72) Inventor: Louie Simmons, Columbus, OH (US)

( * ) Notice: Subject to any disclaimer, the term of this patent is extended or adjusted under 35 U.S.C. 154(b) by 56 days.

(21) Appl. No.: 14/253,159

(22) Filed: Apr. 15, 2014

(65) Prior Publication Data

US 2015/0290489 A1 Oct. 15, 2015

(51) Int. Cl.

| | |
|---|---|
| ***A63B 21/002*** | (2006.01) |
| ***A63B 21/00*** | (2006.01) |
| ***A63B 21/008*** | (2006.01) |
| ***A63B 21/072*** | (2006.01) |
| ***A63B 23/035*** | (2006.01) |

(Continued)

(52) U.S. Cl.

CPC .... *A63B 21/00058* (2013.01); *A63B 21/0023* (2013.01); *A63B 21/0083* (2013.01); *A63B 21/0087* (2013.01); *A63B 21/0626* (2015.10); *A63B 21/0628* (2015.10); *A63B 21/0724* (2013.01); *A63B 23/03575* (2013.01); *A63B 24/0087* (2013.01); *A63B 21/005* (2013.01); *A63B 21/00076* (2013.01); *A63B 21/0084* (2013.01); *A63B 21/0088* (2013.01); *A63B 21/0552* (2013.01); *A63B 21/4015* (2015.10); *A63B 21/4035* (2015.10); *A63B 23/0405* (2013.01); *A63B 23/0494* (2013.01); *A63B 23/1209* (2013.01); *A63B 71/0054* (2013.01); *A63B 2022/0079* (2013.01)

(58) Field of Classification Search

CPC ... A63B 21/06; A63B 21/062; A63B 21/0611; A63B 21/0613; A63B 21/14; A63B 21/1446; A63B 21/148; A63B 21/1488; A63B 21/158; A63B 21/008–21/0088; A63B 21/0012; A63B 21/00047; A63B 21/00185; A63B 21/002; A63B 21/0023

USPC ..... 482/93–104, 111–113, 133–138, 91

See application file for complete search history.

(56) References Cited

U.S. PATENT DOCUMENTS 4,750,739 A * 6/1988 Lange ..... 482/104
4,846,466 A * 7/1989 Stima, III ..... A63B 23/03516 482/112

(Continued)

FOREIGN PATENT DOCUMENTS

ES 2289906 2/2008

OTHER PUBLICATIONS

Extended European Search Report, EU application No. 15002826.4, dated Mar. 9, 2016,7 pages.

*Primary Examiner* — Gregory Winter

(74) *Attorney, Agent, or Firm* — Michael J. Gallagher; Luper Neidenthal and Logan LPA

(57) ABSTRACT

A static and dynamic exercise apparatus has a spatially displaceable object coupled to a frame and a force applicator. A resistance system exerts a first level of resistance that prevents the movement of the object by the application of a user-applied force, thereby allowing a user to generate a static, or isometric, force on the force applicator and object. The resistance system may then be released, to allow movement of the object, thereby rapidly transmuting the static force into a dynamic movement. In various embodiments, the object is a plurality of weights, the force applicator is a weight lifting bar, and the resistance system is a pneumatically actuated piston that is capable of releasably holding the weights and weight bar to the frame.

17 Claims, 3 Drawing Sheets

(51) Int. Cl.

| | |
|---|---|
| ***A63B 24/00*** | (2006.01) |
| ***A63B 21/062*** | (2006.01) |
| *A63B 23/04* | (2006.01) |
| *A63B 71/00* | (2006.01) |
| *A63B 21/005* | (2006.01) |
| *A63B 21/055* | (2006.01) |
| *A63B 23/12* | (2006.01) |
| *A63B 22/00* | (2006.01) |

(56) References Cited

U.S. PATENT DOCUMENTS 4,953,855 A * 9/1990 Shields ..... A63B 21/0628 482/99
5,151,071 A * 9/1992 Jain ..... A63B 21/0628 482/101
5,154,681 A * 10/1992 Denny ..... A63B 21/0724 482/108
5,653,666 A * 8/1997 Pantoleon ..... 482/112
5,669,859 A * 9/1997 Liggett et al. ..... 482/94
6,450,927 B1 * 9/2002 Ellis ..... 482/94
6,746,379 B1 * 6/2004 Brawner ..... A63B 21/078 482/104
7,104,938 B1 * 9/2006 Smith ..... 482/142
7,393,309 B2 * 7/2008 Webber ..... 482/104
7,520,843 B1 * 4/2009 Goddard ..... 482/104
7,578,774 B1 * 8/2009 Zetterberg ..... 482/112
7,591,771 B2 * 9/2009 Rullestad ..... A63B 21/00181 482/104
7,762,963 B2 * 7/2010 Ewing ..... A61H 1/024 482/907
2003/0027695 A1 * 2/2003 Lee ..... 482/99
2005/0032612 A1 * 2/2005 Keiser ..... 482/93
2006/0135324 A1 * 6/2006 Rullestad et al. ..... 482/93
2007/0042876 A1 * 2/2007 Lundquist ..... 482/94
2007/0179030 A1 * 8/2007 Slawinski ..... A63B 21/00181 482/98
2010/0227744 A1 * 9/2010 Dang ..... 482/91
2014/0100083 A1 4/2014 Steiert
2014/0213414 A1 * 7/2014 Balandis ..... A63B 24/0087 482/5

* cited by examiner

STATIC-DYNAMIC EXERCISE APPARATUS AND METHOD OF USING SAME

STATEMENT REGARDING FEDERALLY SPONSORED RESEARCH OR DEVELOPMENT

Not applicable.

TECHNICAL FIELD

The present disclosure relates generally to an apparatus for static and dynamic exercise training and a method for using the same.

BACKGROUND OF THE INVENTION

All bodily movement, including exercise, can be considered as including two broad types of activities; static and dynamic. Static exercise may be generally considered as effort without movement, i.e., the development of a relatively large intramuscular force with little or no change in muscle length, and therefore without significant joint movement. Static exercise is also known as isometric exercise. Dynamic exercise involves changes in muscle length, and therefore joint movement, caused by muscle contractions developing a relatively small intramuscular force. The classifications are to be distinguished from the terms aerobic and anaerobic exercise, which describe the energy metabolism employed in a given exercise, rather than the motion, or lack of motion, produced.

In practical application, these two types of exercise represent the opposite ends of a continuum of movement, with most physical activity combining aspects of both static and dynamic exercise. As will be described below, the present invention includes a Static-Dynamic exercise apparatus, wherein a static exercise is rapidly converted to and continued as a dynamic exercise.

SUMMARY OF THE INVENTION

A static-dynamic exercise apparatus allows the exertion of a static exercise to be rapidly supplanted by a dynamic exercise. Experimentally, it has been found that holding a 2-3 second static (or isometric) contraction at 80% of an individual's maximum effort capacity; followed immediately by an explosive dynamic work load of 30% of maximum effort capacity, is a highly effective method. Additionally, it has been found that that a dynamic muscle acceleration of 0.8-0.9 meters/sec. is highly effective for speed strength development. For strength speed or slow strength development, a protocol of exerting at least 80% of a user's strength potential statically for 2-3 seconds, followed by the application of force as fast as possible, with a load of 90-95% of the user's maximal capacity, achieving an acceleration of 0.4-0.5 m/sec., is also an effective training method.

Such a combined static and dynamic system has been referred to as a quick release technique. In one embodiment of this method, the athlete develops high force under isometric conditions while the body is locked at a pre-determined body position of a plurality of varying angles, commonly one to six varying angles. Next, the static resistance is released and immediately followed by a dynamic action.

Until now, a major difficulty has been the practical one of being able to switch between static and dynamic exercise modes quickly enough for maximum benefit. This problem, among others, is solved by various embodiments of the present invention, which is capable of being rapidly alternated between static and dynamic modes of action. Illustrative examples of various embodiments of the invention, all provided by way of example and not limitation, are described.

BRIEF DESCRIPTION OF THE ILLUSTRATIONS

Without limiting the scope of the static-dynamic exercise apparatus as disclosed herein and referring now to the drawings and figures.

Figure 1:
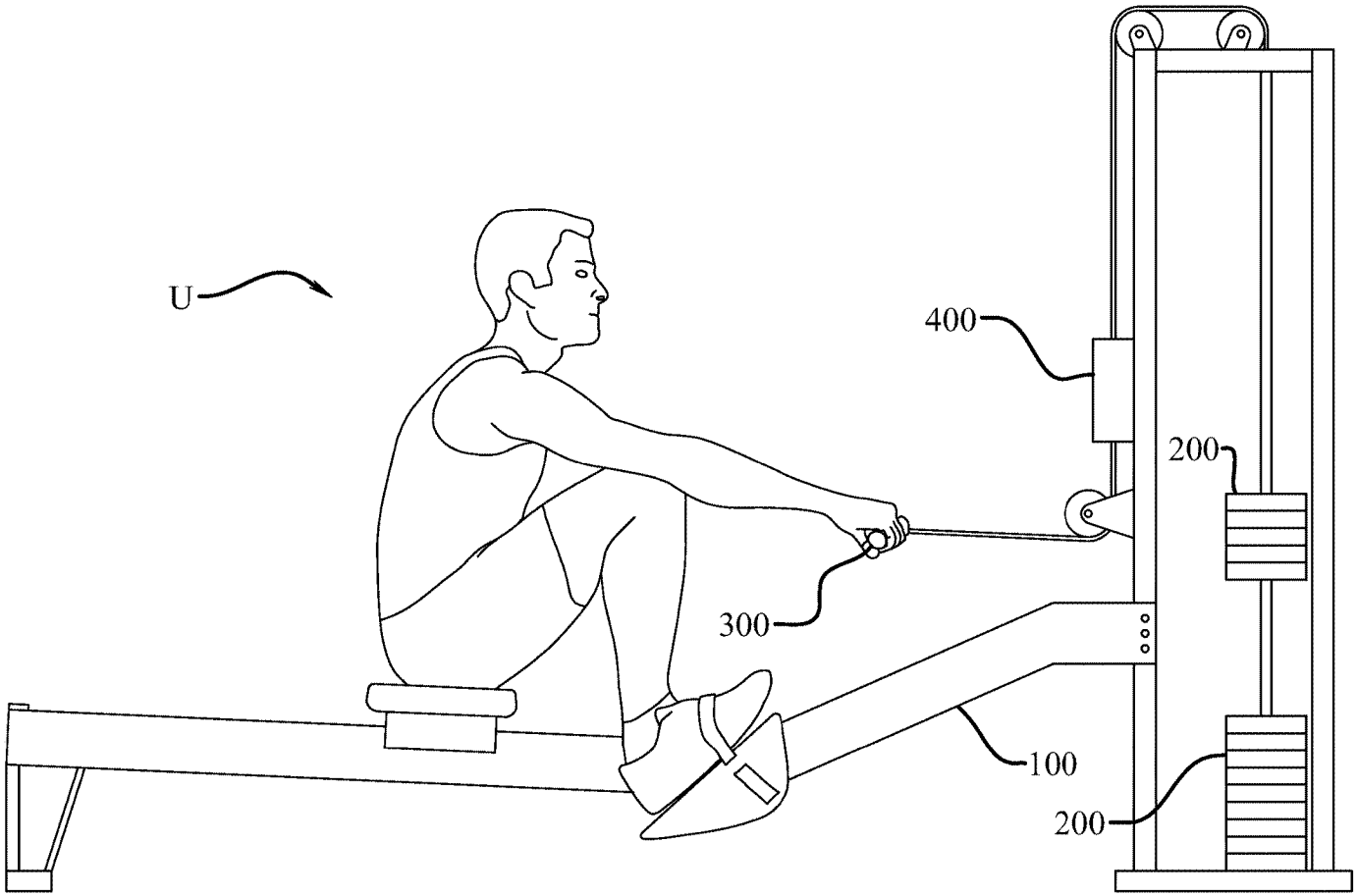
FIG. 1 shows an elevation view of an embodiment of a static-dynamic exercise apparatus.

These illustrations are provided to assist in the understanding of the exemplary embodiments of a static-dynamic exercise apparatus design and method of forming the same, as described in more detail below, and should not be construed as unduly limiting the specification. In particular, the relative spacing, positioning, sizing and dimensions of the various elements illustrated in the drawings may not be drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

Figure 2:
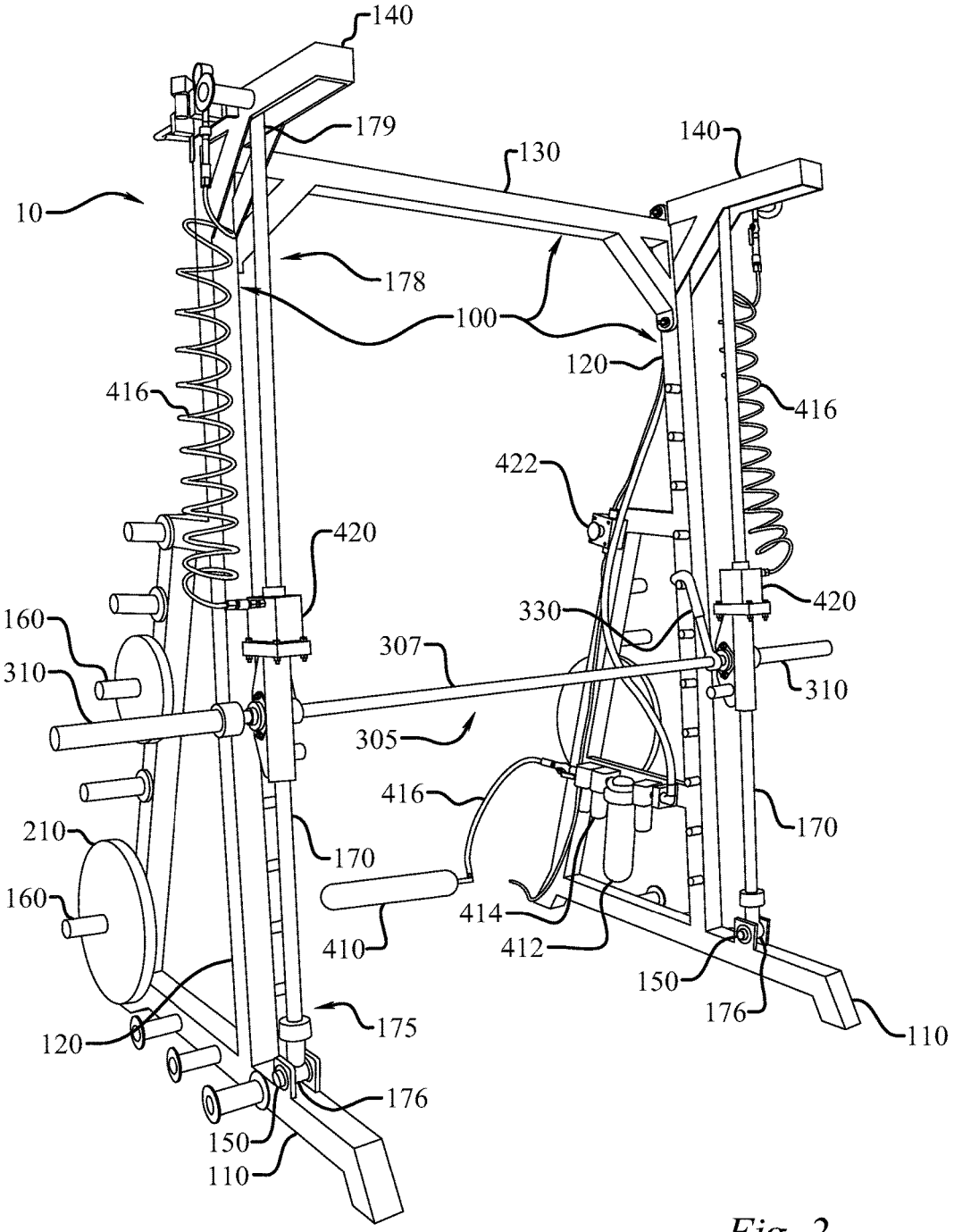
FIG. 2 shows a perspective view of another embodiment of a static-dynamic exercise apparatus.
Figure 3:
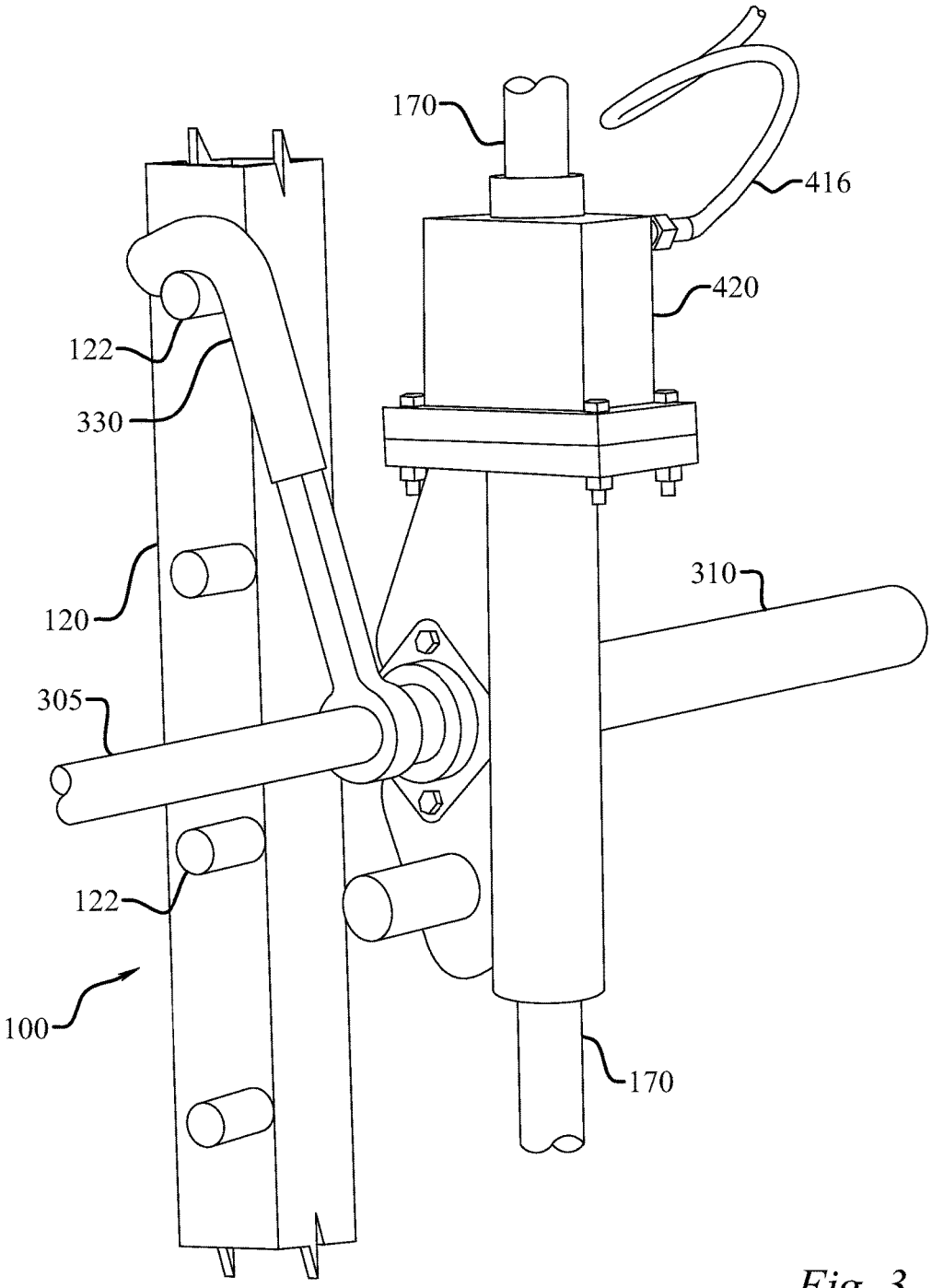
FIG. 3 shows a perspective view of a detail of the embodiment of FIG. 2.

As seen in FIGS. 1-3, certain embodiments of a static dynamic exercise apparatus (10) are seen, although one skilled in the art would recognize many other embodiments based on the principles taught herein. In its simplest form, illustrated essentially schematically in FIG. 1, the apparatus includes four basic components. The first is at least one spatially displaceable object (200) having a predetermined mass. In several common embodiments, the spatially displaceable object (200) will be one or more weights (210), as seen well in FIG. 2. There is no particular design for a weight (210) to be configured, other than it having a predetermined mass; shape or materials are inconsequential, although in common embodiments, steel weightlifting plates may be utilized. However, it is not necessary for the spatially displaceable object (200) to be a weight (210), and could also be a pressure piston actuated within a pressure cylinder (not shown), a means of elastic resistance, or any other object, that is capable of generating a static resistance when there is no movement, and with movement, is capable of creating a dynamic resistance.

The spatially displaceable object (200) may be movably coupled to a support frame (100) to support the components, but again, no special construction of the support frame (100) is required, other than it have the capacity to support the remaining components in a practical and useable manner.

The spatially displaceable object (200) may be coupled to a force applicator (300) capable of transmitting a user-applied force to the spatially displaceable object (200). Again, no special construction is required, the only necessity being that a user may use the force applicator (300) to apply a force to the spatially displaceable object (200). By way of example only, and not limitation, in FIG. 1 the spatially displaceable object (200) is seen as a stack of steel weight plates riding in a tracked frame (100), and the force applicator (300) is there seen as a cable attached to a handle. In this particular and bare-bones embodiment, a user (U) may employ a rowing motion to cause the force applicator (300) to transmit the user applied force to the spatially displaceable object (200). In FIGS. 2-3, again by way of example only, the static-dynamic exercise apparatus (10) is configured in an embodiment where the force applicator (300) is a standard weight lifting bar, and the spatially displaceable object (200) is seen as a plurality of steel weightlifting weights.

Again with reference to FIG. 1, the static-dynamic exercise apparatus may also include a resistance system (400) coupled to the spatially displaceable object (200) that is capable of producing a variable resistance to movement of the spatially displaceable object (200) and the force applicator (300). The resistance system (400) is capable of generating at least a resistance to movement equal to or greater than the user-applied force and the resistance system (400) may be reversibly alternated between at least two predetermined levels of resistance. Again, no particular construction is necessary for the resistance system (400), other than the requirement that it be capable of a first resistance preventing the user-applied force from displacing the spatially displaceable object (200), and that this resistance may be released such that the resistance system (400) generates a second resistance less than the user-applied force, thereby allowing the user to spatially displace the spatially displaceable object (200). The second resistance is optimally as low as can be practically achieved, given the necessary constraints of friction within the mechanism. As detailed above, the term "displace" includes any form of variable resistance, particularly including that which may be provided by pneumatic or hydraulic pressure pistons, or by any form of providing elastic resistance. Therefore, in a preferred embodiment, the at least one spatially displaceable object (200) is at least one metal weight (210), as seen in FIGS. 1-3, but in another preferred embodiment, the spatially displaceable object (200) further comprises a pressure piston in a pressure cylinder capable of generating a fluid pressure.

As seen well in FIG. 2, the support frame (100) may be configured to have at least one rail (170) having a length, a rail lower end (175) and a rail upper end (178). The rail (170) may be slidably coupled at a first predetermined position to an object selected from the objects consisting of the spatially displaceable object (200) and the force applicator (300). Application of a user-applied force may allow the spatially displaceable object (200) to be displaced from the first predetermined position to a second predetermined position along the rail (170) length, when the user-applied force is applied to the force applicator (300).

In one embodiment, seen well in FIG. 2, the rail lower end (175) has a rail lower joint (176) rotably coupled to a rotable rail attachment (150) on the support frame (100) and the rail upper end (178) has a rotation channel engagement area (179) movable within a rotation channel (140) on the frame (100). This allows a predetermined degree of rotational movement of the rail (170) relative to the support frame (100), which tends to allow, in the apparatus pictured, the correction of any deviation from an application of user-applied force that is not applied plumb to the spatially displaceable object (200). In this embodiment, the support frame (100) includes a base (110), at least one lateral support (120) and at least one upper member (130), but one skilled in the art will understand that these are not necessary in all embodiments.

In one series of embodiments, the resistance system (400), as seen well in FIGS. 2-3, includes a pressure generator (410) capable of creating a pressure in fluid communication with a resistance interlock (420). Pressure produced by the pressure generator (410) is transmissible to the resistance interlock (420), thereby creating the variable resistance to movement of the spatially displaceable object (200). In a common series of embodiments, the pressure interlock (420) creates the variable resistance to movement of the spatially displaceable object by means of a plunger or piston exerting a force against the rail (170). The resistance system (400) may have a controller (422) capable of regulating the pressure transmissible to the resistance interlock (420). In a typical embodiment, as seen in FIGS. 2-3, the resistance interlock (420) may include a pneumatic, hydraulic, or electrically powered piston, such that the resistance interlock (420) has a first position in which little or no force is applied by the resistance system (400) and at least a second position wherein a force equal to that necessary to prevent movement of the spatially movable object (200) by application of a user-applied force is applied by the resistance system (400). Any controller (420) may be capable of rapid alternation between the first and second positions.

In embodiments utilizing a pneumatic resistance interlock (420), seen well in FIG. 2, the pressure generator (410) may be in fluid communication with an ambient atmosphere through a filter (412) and which pressurizes the ambient atmosphere to a predetermined pressure greater than that of the ambient atmosphere, wherein the pressurized atmosphere is transmitted through at least one pressure channel (416) to the resistance interlock (420). In a typical embodiment, but one intended by way of example only and not limitation, ambient air is filtered and compressed to operate a pneumatic piston in the resistance interlock (420) regulated by the controller (422).

In yet another embodiment, seen well in FIG. 2 and in part in FIG. 3, and one that will be familiar in concept to traditional weight training practitioners, a static dynamic exercise apparatus (10) may include at least one spatially displaceable object (200) comprising at least one weight (210) having a predetermined mass. The weight (210) may be movably coupled to a support frame (100) and coupled to a force applicator (300) comprising a weight bar (305). In turn, the weight bar (305) may have a gripping area (307), transmissible to a user-applied force to the spatially displaceable object (200).

Again, and as seen in FIGS. 2-3, a resistance system (400) may be coupled to the spatially displaceable object (200) and the force applicator (300), comprising a pressure generator (410), regulated by a pressure regulator (414), in fluid communication with a resistance interlock (420) having a controller (422). The resistance interlock (420) is reversibly capable of producing a variable resistance to movement of the spatially displaceable object (200) and the force applicator (300), including at least a resistance in excess of the user-applied force and wherein the resistance system (400) may be reversibly alternated between at least two predetermined levels of resistance. The at least two predetermined levels of resistance may include a level of no resistance to movement, other than the necessary constraints of friction within the mechanism, and a level of resistance capable of preventing movement of the spatially movable object (200) by the application of a user-applied force.

Since the embodiment described above is configured, by way of example only and not limitation, as using weight (210) plates, users may find it convenient for the support frame (100) to include at least one weight storage attachment (160). It may also be convenient to configure the weight bar (305) to have at least one weight engager (310) releasably connecting the weight bar (305) to the at least one weight (210).

The weight bar (305), as seen in FIG. 2 and in greater detail in FIG. 3, may include at least one weight bar support engager (330) releasably engageable with at least one weight bar support (122) on the support frame (100), thus allowing the frame (100) to provide various positions in which the weight bar (305) may rest.

Those skilled in the art will understand the relationship between the static-dynamic exercise apparatus (10) and a novel means of strength training. This method may include the steps of first, predetermining a maximum achievable user-applied force. Next, one would provide a spatially movable object (200) having a mass and movable with a force equal to a first predetermined percentage of the maximum achievable user-applied force. Experience has shown that a mass of approximately one-third of the mass movable by the maximum user-applied force produces good results, although there may be considerable variation in that number.

One would then provide a resistance to movement of the spatially movable object (200) at least sufficient to overcome a movement caused by the application of a second predetermined percentage, greater than the first predetermined percentage, of the maximum achievable user-applied force. In some cases the second predetermined percentage of the maximum achievable user-applied force may be 100%, however in other preferred embodiments, the second predetermined percentage of the maximum achievable user-applied force may be in the 80-90% range. In other embodiments, the second predetermined percentage of the maximum achievable user-applied force may be any percentage greater than the first predetermined percentage.

Next, one may allow the user (U) to apply the second predetermined percentage of the maximum achievable user-applied force to the spatially movable object (200); and then release the resistance to movement of the spatially movable object (200). This would allow the second percentage of the maximum achievable user-applied force to move the spatially moveable object (200); converting what had been a static exercise to a dynamic one. In order that the change from static to dynamic exercise be made as quickly as possible, it is generally desirable for the step of releasing the resistance to movement of the spatially movable object (200) be accomplished as quickly as possible, and in a series of preferred embodiments, the resistance is released in less than one-tenth of a second.

Since the release of resistance results in an explosive movement of the spatially displaceable object (200), as a safety measure, a step of providing an increased resistance to movement of the spatially movable object (200) after the object has moved a predetermined distance may be employed. This may bring the spatially displaceable object (200) to rest in a predetermined controlled fashion.

In an alternative training method using the static-dynamic exercise apparatus, a user may hold a light load, statically, at one or more predetermined elevated positions, while in a relaxed muscle state. Releasing the static mode allows the load to fall at the speed of acceleration of gravity near earth, approximately 9.8 m/s. At that point the user may catch the bar load, eliciting a stretch reflex response. The load may then be reversed in movement, against gravity, in a concentric action.

Numerous alterations, modifications, and variations of the preferred embodiments disclosed herein will be apparent to those skilled in the art and they are all anticipated and contemplated to be within the spirit and scope of the disclosed specification. For example, although specific embodiments have been described in detail, those with skill in the art will understand that the preceding embodiments and variations can be modified to incorporate various types of substitute and or additional or alternative materials, relative arrangement of elements, order of steps and additional steps, and dimensional configurations. Accordingly, even though only few variations of the method and products are described herein, it is to be understood that the practice of such additional modifications and variations and the equivalents thereof, are within the spirit and scope of the method and products as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A static dynamic exercise apparatus (10) comprising:

a. at least one spatially displaceable object (200) having a predetermined object resistance to movement movably fastened to a support frame (100) and fastened to a force applicator (300) having a predetermined force applicator resistance to movement throughout a range of motion and capable of transmitting a predetermined user-applied force sufficient to move the spatially displaceable object (200);

b. a resistance system (400) coupled to the spatially displaceable object (200) and the force applicator (300) capable of producing a variable resisting force to movement throughout the range of motion of the spatially displaceable object (200) and the force applicator (300), equal to or greater than the sum of the predetermined object resistance to movement, the predetermined force applicator resistance to movement and the predetermined user-applied force sufficient to move the spatially displaceable object (200) and wherein the resistance system (400) is reversibly alternatable between at least two predetermined levels of resisting force throughout the range of motion wherein at least a first predetermined levels of resisting force acts to lock the spatially displaceable object against movement in at least two directions in a first predetermined position, and a second predetermined levels of resisting force adds no additional resistance to the sum of the predetermined object resistance to movement and the predetermined force applicator resistance to movement, c. wherein the first and second predetermined levels of resisting force are alternated under full load of the spatially displaceable object (200) having a predetermined object resistance to movement, and d. wherein the spatially displaceable object (200) and the force applicator (300) remain fastened while the apparatus is in use.

2. The apparatus (10) according to claim 1, wherein the at least one spatially displaceable object (200) is at least one metal weight (210).

3. The apparatus (10) according to claim 1, wherein the support frame (100) further comprises at least one rail (170) having a length, a rail lower end (175) and a rail upper end (178), slidably coupled at a first predetermined position to at least one object selected from the objects consisting of the spatially displaceable object (200) and the force applicator (300), wherein the spatially displaceable object (200) may be displaced to a second predetermined position on the rail (170) length by the application of the user-applied force to the force applicator (300).

4. The apparatus (10) according to claim 3, wherein the rail lower end (175) has a rail lower joint (176) rotably coupled to a rotable rail attachment (150) on the support frame (100) and the rail upper end (178) has a rotation channel engagement area (179) movable within a rotation channel (140) on the frame (100) allowing a predetermined degree of rotational movement of the rail (170) relative to the support frame (100).

5. The apparatus (10) according to claim 1, wherein the support frame (100) includes at least one lateral support (120) coupled to a base (110) and at least one upper member (130).

6. The apparatus (10) according to claim 1, wherein the resistance system (400) further comprises a pressure generator (410) capable of creating a pressure in fluid communication with a resistance interlock (420), wherein pressure produced by the pressure generator (410) is transmissible to the resistance interlock (420), thereby creating the variable resistance to movement of the spatially displaceable object (200).

7. The apparatus (10) according to claim 6, wherein the resistance system (400) further comprises a controller (422) capable of regulating the pressure transmissible to the resistance interlock (420).

8. The apparatus (10) according to claim 6, wherein the pressure generator (410) generates a pressure in fluid communication with an ambient atmosphere through a filter (412) and pressurizes the ambient atmosphere to a predetermined pressure regulated by a pressure regulator (414) and transmitted through at least one pressure channel (416) to the resistance interlock (420).

9. A static dynamic exercise apparatus (10) comprising:

a. at least one weight (210) having a predetermined weight resistance to movement movably fastened to a support frame (100) and fastened to a weight bar (305) having a bar resistance to movement throughout a range of motion and a gripping area (307), transmissible of a predetermined user-applied force sufficient to move the weight (210);

b. a pressure generator (410) coupled to the weight (210) and the weight bar (305), in fluid communication with a resistance interlock (420) having a controller (422); wherein the resistance interlock (420) is reversibly capable of producing a variable resisting force to movement throughout the range of motion of the weight (210) and weight bar (305), equal to or greater than the sum of the predetermined weight resistance to movement, the bar resistance to movement and the predetermined user-applied force sufficient to move the weight and wherein the resistance interlock (420) is reversibly alternatable between at least two predetermined levels of resisting force throughout the range of motion wherein at least one of the predetermined levels of resisting force acts to lock the weight (210) against movement in at least two directions in a first predetermined position, and one of the predetermined levels of resisting force adds no additional resistance to the sum of the predetermined weight (210) resistance to movement and the predetermined weight bar (305) resistance to movement, c. wherein the first and second predetermined levels of resisting force are alternated under full load of the weight (210) having a predetermined weight resistance to movement, and d. wherein the weight (210) and weight bar (305) remain fastened while the apparatus is in use.

10. The apparatus according to claim 9, wherein the support frame (100) further comprises at least one weight storage attachment (160).

11. The apparatus (10) according to claim 9, wherein the weight bar (305) has at least one weight engager (310) releasably connecting the weight bar (305) to the at least one weight (210).

12. The apparatus (10) according to claim 9, wherein the weight bar (305) further comprises at least one weight bar support engager (330) releasably engageable with at least one weight bar support (122) on the support frame (100).

13. The apparatus according to claim 1, wherein the at least one spatially displaceable object (200) movably fastened to the support frame (100) is movably and reversibly fastened to the support frame (100).

14. The apparatus according to claim 1, wherein the at least one spatially displaceable object (200) fastened to the force applicator (300) is reversibly fastened to the force applicator (300).

15. The apparatus according to claim 9, wherein the at least one weight (210) movably fastened to the support frame (100) is movably and reversibly fastened to the support frame (100).

16. The apparatus according to claim 9, wherein the at least one weight (210) fastened to the weight bar (305) is reversibly fastened to the weight bar (305).

17. The apparatus according to claim 1, wherein the resistance system (400) capable of producing the variable resisting force to movement of the spatially displaceable object (200) and the force applicator (300) further comprises an electrically powered resistance system (400) capable of producing the variable resisting force to movement of the spatially displaceable object (200) and the force applicator (300).

* * * * *